US010967659B2

(12) United States Patent
Fukuoka

(10) Patent No.: US 10,967,659 B2
(45) Date of Patent: Apr. 6, 2021

(54) INKJET RECORDING APPARATUS AND INKJET RECORDING METHOD

(71) Applicant: KYOCERA Document Solutions Inc., Osaka (JP)

(72) Inventor: Junichi Fukuoka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/750,778

(22) Filed: Jan. 23, 2020

(65) Prior Publication Data

US 2020/0254793 A1 Aug. 13, 2020

(30) Foreign Application Priority Data

Feb. 12, 2019 (JP) ..... JP2019-022356

(51) Int. Cl.
*B41J 15/04* (2006.01)

(52) U.S. Cl.
CPC ..... *B41J 15/048* (2013.01)

(58) Field of Classification Search
CPC ..... B41J 15/048; B41J 15/16; B41J 11/42; B65H 23/18; B65H 43/00
See application file for complete search history.

(56) References Cited

U.S. PATENT DOCUMENTS 8,979,236 B1 * 3/2015 Idehara ..... B41J 11/36 347/16
2004/0141198 A1 7/2004 Otsuki ..... 358/1.12

FOREIGN PATENT DOCUMENTS

JP 2004-74708 A 3/2004

* cited by examiner

*Primary Examiner* — Thinh H Nguyen
(74) *Attorney, Agent, or Firm* — Stein IP, LLC

(57) ABSTRACT

An inkjet recording apparatus includes a feeding-side motor, an inkjet recording unit, a winding-side motor, a feeding-side roll-diameter measuring unit, a winding-side roll-diameter measuring unit, and a motor drive controller. Based on a relationship between motor rotating speeds and roll diameters under conveyance of the recording medium at a specified conveyance speed, the motor drive controller determines a first rotating speed corresponding to a feeding-side roll diameter measured by the feeding-side roll-diameter measuring unit and moreover determines a second rotating speed corresponding to a winding-side roll diameter measured by the winding-side roll-diameter measuring unit to drive the feeding-side motor at the first rotating speed and moreover drive the winding-side motor at the second rotating speed.

9 Claims, 4 Drawing Sheets

INKJET RECORDING APPARATUS AND INKJET RECORDING METHOD

INCORPORATION BY REFERENCE

This application is based upon and claims the benefit of priority from the corresponding Japanese Patent Application No. 2019-022356 filed on Feb. 12, 2019, the entire contents of which are incorporated herein by reference.

BACKGROUND

The present disclosure relates to an inkjet recording apparatus and an inkjet recording method.

Conventionally, there has been proposed an inkjet recording apparatus which, with use of roll media having a recording medium wound in roll shape, ejects ink onto the recording medium to record images. In this type of inkjet recording apparatus, the roll media is rotated by rotation of a motor to feed out the recording medium from the roll media, then ejecting ink onto the recording medium to record an image thereon. The recording medium with the image recorded thereon is wound up again into roll shape. Hereinafter, an already-recorded recording medium wound up into roll shape will be referred to also as 'recorded media.'

Now, with a constant rotating speed of the motor assumed, the larger the roll diameter of the roll media is, the more the feed quantity (conveyance quantity) per unit time of the recording medium fed out from the roll media increases; and, conversely, the smaller the roll diameter is, the more the feed quantity per unit time of the recording medium decreases. Variations of the feed quantity of the recording medium leads to disorder of the image to be recorded on the recording medium by ink ejection. Therefore, it becomes necessary to reduce (correct) variations of the feed quantity.

Among techniques for correcting the feed quantity of the recording medium, for example, the following technique is known. That is, with regard to a sheet of paper fed out from roll media, a feed quantity of the sheet is acquired by detecting, with an encoder, a rotation quantity of a roller that conveys the sheet. Then, sheet remaining-quantity information is generated based on the acquired feed quantity of the sheet, and an objective conveyance quantity of the sheet is corrected by a correction quantity corresponding to the sheet remaining-quantity.

Upon an end of image recording by the ink ejection onto the recording medium, the used roll media is decoupled from the recorded media, and replaced with other roll media of a different type (e.g., in thickness or width of recording medium). Then, image recording by ink ejection is performed again onto the recording medium fed out from the after-replacement roll media.

In this aspect, in the case of brand-new roll media as an example, its roll diameter (remaining quantity of recording medium) is knowable beforehand by indication from the manufacturer. Therefore, when brand-new l media is used as above-mentioned other roll media, a remaining quantity of the recording medium after use can be estimated from a roll diameter or remaining quantity of the roll media at the beginning (before use) and a feed quantity of the recording medium during the use. Accordingly, in this case, it is implementable, as in the above-described technique, to correct an objective conveyance quantity of the recording medium with a correction quantity responsive to the remaining quantity.

In another case, with regard to roll media (used media) that has formerly been used halfway as an example, a former-use quantity of the recording medium is unknown and so its roll diameter is unknown. Therefore, in cases where image recording by ink ejection is performed by replacing roll media with used media, an after-use remaining quantity of the recording medium cannot be estimated. Thus, it is impracticable to correct an objective conveyance quantity of the recording medium by a correction quantity responsive to the remaining quantity.

SUMMARY

An inkjet recording apparatus according to one aspect of the present disclosure includes: a feeding-side motor for rotating roll media with a recording medium wound thereon in roll shape to feed out the recording medium from the roll media; an inkjet recording unit for ejecting ink onto the recording medium fed out from the roll media to record an image on the recording medium; a winding-side motor for winding, into roll shape, the recording medium with the image recorded thereon by the inkjet recording unit; a feeding-side roll-diameter measuring unit for measuring a roll diameter of the roll media as a feeding-side roll diameter; a winding-side roll-diameter measuring unit for measuring, as a winding-side roll diameter, a roll diameter of recorded media with the recording medium wound thereon in roll shape by the winding-side motor; and a motor drive controller for controlling respective drive of the feeding-side motor and the winding-side motor. Based on a relationship between motor rotating speeds and roll diameters under conveyance of the recording medium at a specified conveyance speed, the motor drive controller determines a first rotating speed corresponding to the feeding-side roll diameter measured by the feeding-side roll-diameter measuring unit and moreover determines a second rotating speed corresponding to the winding-side roll diameter measured by the winding-side roll-diameter measuring unit to drive the feeding-side motor at the first rotating speed and moreover drive the winding-side motor at the second rotating speed.

An inkjet recording method according to another aspect of the disclosure includes the steps of: rotating roll media with a recording medium wound thereon in roll shape by a feeding-side motor to feed out the recording medium from the roll media; ejecting ink onto the recording medium fed out from the roll media to record an image on the recording medium; winding, into roll shape, the recording medium with the image recorded thereon by a winding-side motor; measuring a roll diameter of the roll media as a feeding-side roll diameter; measuring, as a winding-side roll diameter, a roll diameter of recorded media with the recording medium wound thereon in roll shape by the winding-side motor; and based on a relationship between motor rotating speeds and roll diameters under conveyance of the recording medium at a specified conveyance speed, determining a first rotating speed corresponding to the feeding-side roll diameter and moreover determining a second rotating speed corresponding to the winding-side roll diameter to drive the feeding-side motor at the first rotating speed and moreover drive the winding-side motor at the second rotating speed.

Further objectives of the present disclosure as well as concrete advantages obtained by the disclosure will become more apparent from the description of an embodiment given below.

DETAILED DESCRIPTION

As described above, in a case where image recording by ink ejection is performed by replacing roll media with used media, remaining quantity of the recording medium after use cannot be estimated, making it impossible to correct an objective conveyance quantity of the recording medium. Therefore, as a result of this, image quality of images recorded on the recording medium is declined due to variations of the conveyance quantity of the recording medium.

In addition, another method is available in which, for example, a storage device is provided on an inner circumferential surface of a core material of roll media and, with sheet remaining-quantity information stored in the storage device, the sheet remaining-quantity information is read out from the storage device as required. However, with this method, usable roll media are limited to those equipped with a storage device, and roll media having no storage device are unusable. Besides, providing every unit of roll media with a storage device leads to increase in cost of the roll media. Thus, it is desired that image-quality degradation of recorded images due to variations in conveyance quantity of the recording medium can be avoided without providing any storage device for every unit of roll media to manage the remaining quantity.

An object of the present disclosure is to provide an inkjet recording apparatus and an inkjet recording method capable of, even when used roll media is used, avoiding image-quality degradation of recorded images due to variations in conveyance quantity of the recording medium without providing every unit of roll media with a storage device for management of the remaining quantity of the recording medium. Hereinbelow, an embodiment of the disclosure will be described with reference to the accompanying drawings.

(Outlined Configuration of Inkjet Recording Apparatus)

Figure 1:
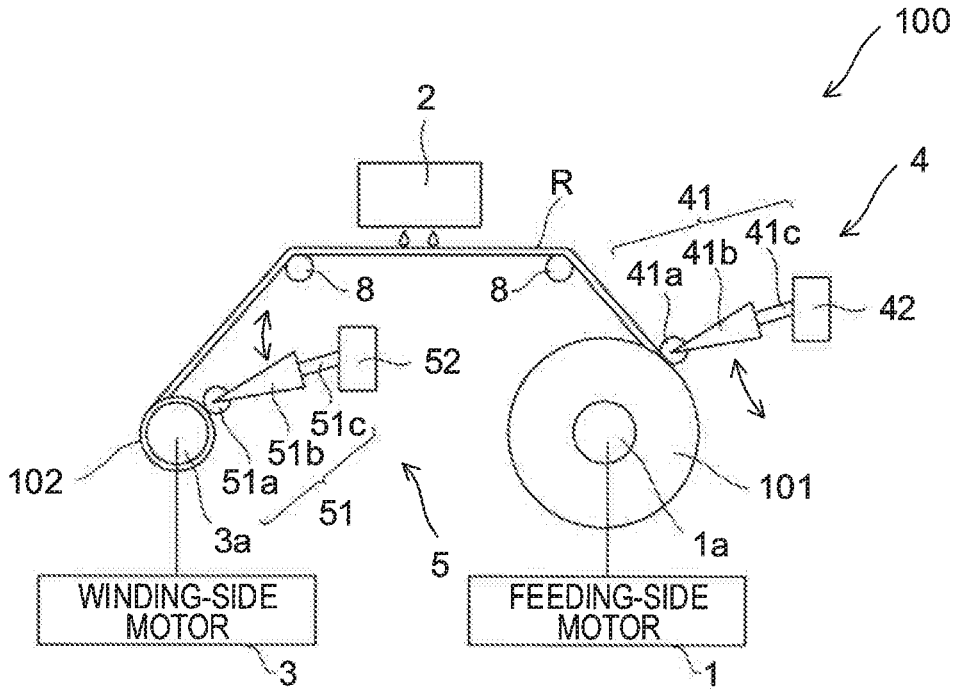
FIG. 1 is an explanatory view showing an outlined configuration of an inkjet recording apparatus according to one embodiment of the present disclosure.
Figure 2:
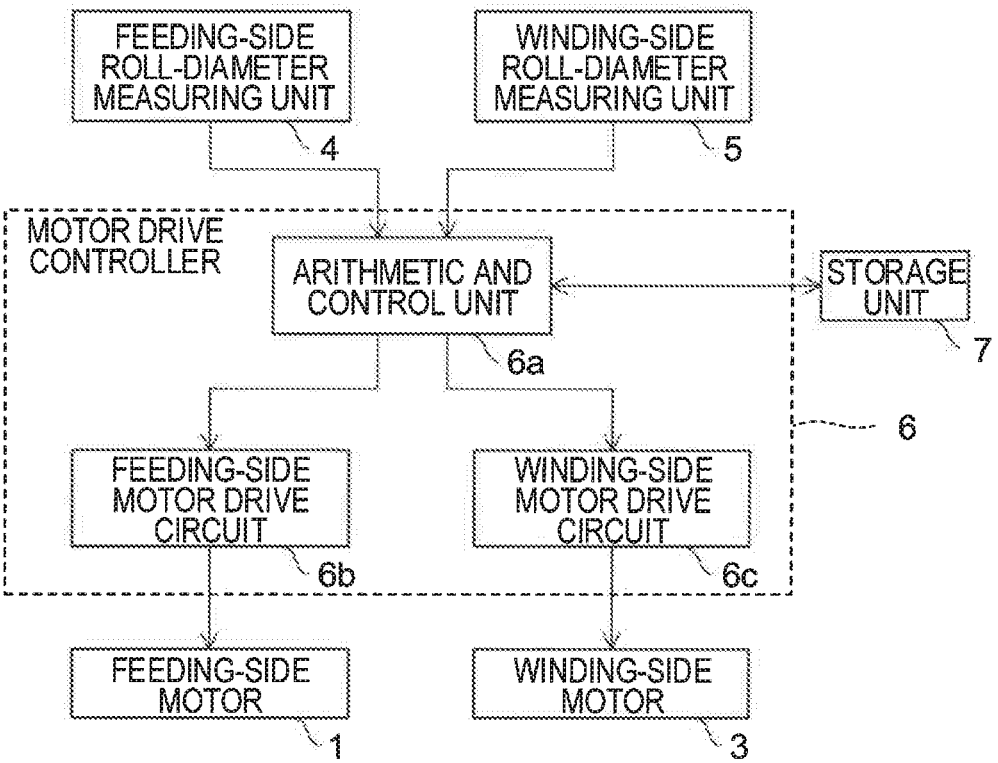
FIG. 2 is a block diagram schematically showing a configuration of main part of the inkjet recording apparatus.
Figure 3:
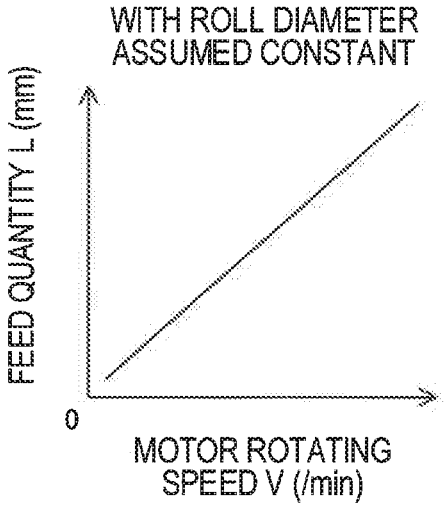
FIG. 3 is a chart showing a relationship between rotating speed of the motor and feed quantity of the recording medium with the roll diameter assumed constant.

An embodiment of the disclosure will be described with reference to the accompanying drawings hereinbelow. FIG. 1 is an explanatory view showing an outlined configuration of an inkjet recording apparatus 100 according to one embodiment of the disclosure. FIG. 2 is a block diagram schematically showing a configuration of main part of the inkjet recording apparatus 100. The inkjet recording apparatus 100 includes a feeding-side motor 1, an inkjet recording unit 2, a winding-side motor 3, a feeding-side roll-diameter measuring unit 4, a winding-side roll-diameter measuring unit 6, a motor drive controller 6, a storage unit 7, and a conveyance roller 8.

The feeding-side motor 1 rotates roll media 101 with a recording medium R wound thereon in roll shape, so that the recording medium R is fed out from the roll media 101 toward the inkjet recording unit 2, In more detail, the roll media 101 has a hollow core with the recording medium R wound thereon. Fitting the core to a shaft portion 1*a* which is to be connected to a rotating shaft of the feeding-side motor 1 allows the roll media 101 to be set to the inkjet recording apparatus 100. The feeding-side motor 1 rotates the rotating shaft to transmit driving force to the shaft portion 1*a* , to which the core is fitted, so that the shaft portion 1*a* is rotated to thereby rotate the roll media 101. As a result, the recording medium R is fed out from the roll media 101 and conveyed on by a plurality of conveyance rollers 8. It is noted that the rotating shaft of the feeding-side motor 1 and the shaft portion 1*a* may be either directly coupled to each other or indirectly coupled to each other via a gear or other power transmission member. The recording medium R may be cloth (e.g., fabric), paper, film or the like, and here is explained a case in which cloth is used as an example.

The inkjet recording unit 2 ejects ink onto the recording medium R fed out from the roll media 101 to record images. The inkjet recording unit 2 is configured by including four recording heads for ejecting four-color inks of cyan (C), magenta (M), yellow (Y) and black (Bk), respectively, as an example. Based on image data transmitted from an external computer, the inkjet recording unit 2 ejects ink from each recording head toward the recording medium R, by which a color image with the four-color inks superimposed together on the recording medium R is formed. In addition, on a downstream side of the inkjet recording unit 2 in a conveyance direction of the recording medium R, a drying unit may also be provided to dry ink ejected onto the recording medium R.

The winding-side motor 3 winds up the recording medium R, into roll shape, on which an image has been recorded by the inkjet recording unit 2. More specifically, a forward end of the recording medium R is fixed to the hollow core serving as a winding shaft for the recording medium R, and then the core is fitted to a shaft portion 3*a* coupled to a rotating shaft of the winding-side motor 3. The winding-side motor 3 rotates the rotating shaft to transmit driving force to the shaft portion 3*a* so that the shaft portion 3*a* is rotated to wind up the recording medium R around the core. It is noted that the rotating shaft of the winding-side motor 3 and the shaft portion 3*a* may be either directly coupled to each other or indirectly coupled to each other via a gear or other power transmission member.

The feeding-side roll-diameter measuring unit 4 measures a roll diameter of the roll media 101 as a feeding-side roll diameter. The feeding-side roll-diameter measuring unit 4 is configured by including a feeding-side actuator 41 and a feeding-side displacement sensor 42.

The feeding-side actuator 41, which is set into contact with an outermost circumferential surface of the roll media 101, undergoes displacement in response to variations of the feeding-side roll diameter. The feeding-side actuator 41 includes a roller 41*a* , a supporter 41*b* for supporting the roller 41*a* , a rod 41*c* having one end fixed to a pivotal shaft (not shown) and the other end coupled to the supporter 41*b* , and a biasing member (not shown). The biasing member is formed of, for example, a plate spring to bias the rod 41*c* in such a direction as to set the roller 41*a* into contact with the roll media 101. Accordingly, the roller 41*a* is normally kept in contact with the outermost circumferential surface of the roll media 101 so as to be rotated along with rotation of the roll media 101 (feed-out of the recording medium R).

Based on a displacement of the feeding-side actuator 41 (particularly, rod 41*c* ), the feeding-side displacement sensor 42 detects a feeding-side roll diameter. Such a feeding-side displacement sensor 42 may be configured by including a light-emitting element (e.g. LED) and a light-receiving element (e.g., photodiode), for example, as in a meander sensor which detects a sheet meander in common image forming apparatuses.

That is, positioning the rod 41*c* between the light-emitting element and the light-receiving element makes it possible to detect a position of the rod 41*c* depending on whether or not light emitted from the light-emitting element has been received by the light-receiving element. As the feeding-side roll diameter has changed due to feed-out of the recording medium R, the roller 41*a* in contact with the roll media 101 is moved, causing the supporter 41*b* and the rod 41*c* to be pivoted and displaced resultantly. A position of the rod 41*c* after the displacement can be detected by the light-receiving element as described above. Accordingly, preparatorily associating detection positions of the rod 41*c* with feeding-side roll diameters makes it possible to determine a feeding-side roll diameter from a detected position of the rod 41*c* in the feeding-side displacement sensor 42.

The winding-side roll-diameter measuring unit 5 measures, as a winding-side roll diameter, a roll diameter of recorded media 102 on which the recording medium R has been wound up in roll shape by the winding-side motor 3. The winding-side roll-diameter measuring unit 5 is configured by including a winding-side actuator 51 and a winding-side displacement sensor 52.

The winding-side actuator 51, which is in contact with an outermost circumferential surface of the recorded media 102, is displaced in response to variations of the winding-side roll diameter. The winding-side actuator 51 includes a roller 51*a* , a supporter 51*b* for supporting the roller 51*a* , a rod 51*c* having one end fixed to a pivotal shaft (not shown) and the other end coupled to the supporter 51*b* , and a biasing member (not shown). The biasing member is formed of, for example, a plate spring to bias the rod 51*c* in such a direction as to set the roller 51*a* into contact with the recorded media 102. Accordingly, the roller 51*a* is normally kept in contact with the outermost circumferential surface of the recorded media 102, and is rotated along with rotation of the recorded media 102.

Based on a displacement of the winding-side actuator 51 (particularly, rod 51*c* ). the winding-side displacement sensor 52 detects a winding-side roll diameter. Such a winding-side displacement sensor 52 may be configured by including a light-emitting element (e.g., LED) and a light-receiving element (e.g., photodiode), as in the feeding-side displacement sensor 42.

That is, positioning the rod 51*c* between the light-emitting element and the light-receiving element makes it possible to detect a position of the rod 51*c* depending on whether or not light emitted from the light-emitting element has been received by the light-receiving element. As the winding-side roll diameter has changed due to winding of the recording medium R, the roller 51*a* in contact with the recorded media 102 is moved, causing the supporter 51*b* and the rod 51*c* to be pivoted and displaced resultantly. A position of the rod 51*c* after the displacement can be detected by the light-receiving element as described above. Accordingly, preparatorily associating detection positions of the rod 51*c* with winding-side roll diameters makes it possible to determine a winding-side roll diameter from a detected position of the rod 51*c* in the winding-side displacement sensor 52.

The motor drive controller 6 controls respective drive of the feeding-side motor 1 and the winding-side motor 3. Details of the motor drive controller 6 will be described later.

The storage unit 7 stores therein control programs for operating the motor drive controller 6, and a table showing a relationship between motor rotating speeds and roll diameters under conveyance of the recording medium R at a specified conveyance speed. Such a storage unit 7 is configured in one o ore combinations selected from among a group of ROM, RAM, hard disk, nonvolatile memory and the like.

FIG, 3 is a chart showing a relationship between rotating speed V (/min) of the motor and feed quantity L (mm) per unit time (e.g., 1 min) of the recording medium R with the roll diameter r (mm) assumed constant. Among the roll diameter r, the rotating speed V and the feed quantity L, the following relationship holds. Consequently, with the roll diameter r assumed constant, the rotating speed V and the feed quantity L are in a proportional relationship with each other:

$$L=r\times\pi\times V.$$

Figure 4:
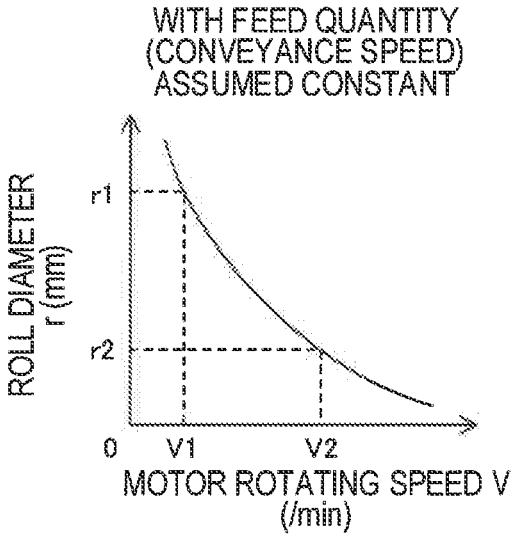
FIG. 4 is a chart showing a relationship between rotating speed of the motor and roll diameter with the feed quantity of the recording medium assumed constant.

Meanwhile, FIG. 4 is a chart showing a relationship between rotating speed V of the motor and roll diameter r on condition that the feed quantity L per unit time of the recording medium R is constant. With the feed quantity L assumed constant, it follows from the above equation that the roll diameter r and the rotating speed V are in an inversely proportional relationship, yielding such a chart as in FIG. 4. In this embodiment, a table showing a relationship as shown in FIG. 4, i.e. a table showing a relationship between motor rotating speed V and roll diameter r under conveyance of the recording medium R at a specified conveyance speed, has been stored in the storage unit 7. In addition, the specified conveyance speed is determined depending on specifications of the inkjet recording apparatus 100, the speed being a value unique to the individual inkjet recording apparatus 100.

(Details of Motor Drive Controller)

Next, the above-described motor drive controller 6 will be explained in details. As shown in FIG. 2, the motor drive controller 6 is configured by including an arithmetic and control unit 6*a* , a feeding-side motor drive circuit 6*b* , and a winding-side motor drive circuit 6*c*.

The arithmetic and control unit 6*a* is implemented by, e.g., a CPU to determine a rotating speed (first rotating speed) of the feeding-side motor 1 and a rotating speed (second rotating speed) of the winding-side motor 3 under conveyance of the recording medium R at a specified conveyance speed, on a basis of a feeding-side roll diameter measured by the feeding-side roll-diameter measuring unit 4, a winding-side roll diameter measured by the winding-side roll-diameter measuring unit 5, and a table stored in the storage unit 7.

The feeding-side motor drive circuit 6*b* generates a drive signal (drive voltage, drive current) for rotating the feeding-side motor 1 at a first rotating speed determined by the arithmetic and control unit 6*a* and feeds the drive signal to the feeding-side motor 1 to rotate the feeding-side motor 1, The winding-side motor drive circuit 6*c* generates a drive signal (drive voltage, drive current) for rotating the winding-side motor 3 at a second rotating speed determined by the arithmetic and control unit 6*a* and feeding the drive signal to the winding-side motor 3 to rotate the winding-side motor 3.

Figure 5:
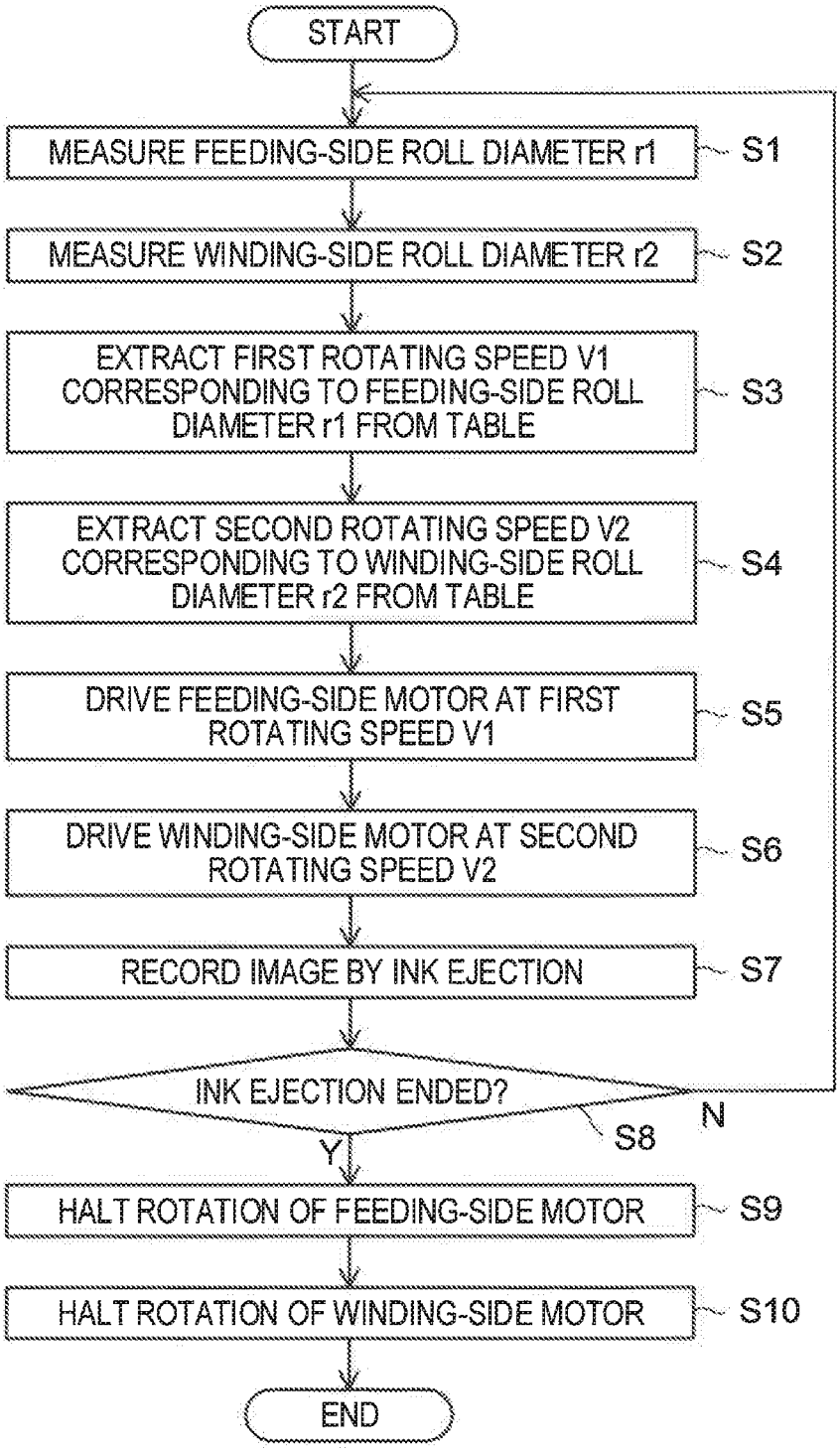
FIG. 5 is a flowchart showing a flow of operations relating to drive of a feeding-side motor and a winding-side motor in the inkjet recording apparatus.

FIG. 5 is a flowchart showing a flow of operations relating to drive of the feeding-side motor 1 and the winding-side motor 3. A feeding-side roll diameter r1 is measured by the feeding-side roll-diameter measuring unit 4 (S1), and a winding-side roll diameter r2 is measured by the winding-side roll-diameter measuring unit 5 (S2). Then, by looking up to the table stored in the storage unit 7, the arithmetic and control unit 6*a* determines a first rotating speed V1 (/min) corresponding to the measured feeding-side roll diameter r1 (mm) as well as a second rotating speed V2 (/min) corresponding to the measured winding-side roll diameter r2 (mm) (S3, S4).

Next, the feeding-side motor drive circuit 6*b* generates a drive signal for rotating the feeding-side motor 1 at the first rotating speed V1 and feeds the drive signal to the feeding-side motor 1 to rotate the feeding-side motor 1 (S5). Also, the winding-side motor drive circuit 6*c* generates a drive signal for rotating the winding-side motor 3 at the second rotating speed V2 and feeds the drive signal to the winding-side motor 3 to rotate the winding-side motor 3 (S6).

In parallel to the feed-out of the recording medium R by the rotation of the feeding-side motor 1 and the winding of the recording medium R by the rotation of the winding-side motor 3, ink ejection onto the recording medium R by the inkjet recording unit 2 is executed (S7). By communicating with the inkjet recording unit 2 as an example, the motor drive controller 6 (arithmetic and control unit 6*a* ) decides whether or not ink ejection has been ended (S8), where when it is not ended, the processing flow returns to S1 to repeat the step and following steps.

In this aspect, the feeding-side roll diameter continuously decreases with continuous feed-out of the recording medium R. According to the relationship shown in FIG. 4, as the feeding-side roll diameter decreases, the first rotating speed of the feeding-side motor 1 needs to be increased in order to maintain the conveyance speed of the recording medium R constant. Therefore, in the repetition of steps S1 to S8, the motor drive controller 6 executes such rotational drive as to continuously increase the first rotating speed of the feeding-side motor 1.

Meanwhile, the winding-side roll diameter continuously increases with continuous winding of the recording medium R. According to the relationship shown in FIG. 4, as the winding-side roll diameter increases, the second rotating speed of the winding-side motor 3 needs to be decreased in order to maintain the conveyance speed of the recording medium R constant. Accordingly, in the repetition of steps S1 to S8, the motor drive controller 6 executes such rotational drive as to continuously decrease the second rotating speed of the winding-side motor 3.

That is, in the case where the steps of S1 to S8 are repeated, the motor drive controller 6 drives the feeding-side motor 1 in such a way that the first rotating speed continuously increases in response to continuous decrease of the feeding-side roll diameter by the feed-out of the recording medium R. Moreover, the motor drive controller 6 drives the winding-side motor 3 in such a way that the second rotating speed continuously decreases in response to continuous increase of the winding-side roll diameter.

At step S8, when deciding that ink ejection has been ended, the motor drive controller 6 (arithmetic and control unit 6*a* ) controls the feeding-side motor drive circuit 6*b* to halt the rotation of the feeding-side motor 1, and moreover controls the winding-side motor drive circuit 6*c* to halt the rotation of the winding-side motor 3 (S9, S10). Thus, a sequence of processes is ended.

As described above, in this embodiment, according to the table stored in the storage unit 7, the motor drive controller 6 determines a first rotating speed corresponding to a feeding-side roll diameter measured by the feeding-side roll-diameter measuring unit 4, and moreover determines a second rotating speed corresponding to a winding-side roll diameter measured by the winding-side roll-diameter measuring unit 5. Then, the motor drive controller 6 drives the feeding-side motor 1 with the first rotating speed, and drives the winding-side motor 3 with the second rotating speed (S3 to S6).

The above-mentioned first rotating speed is a rotating speed of the feeding-side motor 1 corresponding to the feeding-side roll diameter in an aspect in which the recording medium R is being conveyed at a specified conveyance speed, Also, the above-mentioned second rotating speed is a rotating speed of the winding-side motor 3 corresponding to the winding-side roll diameter in an aspect in which the recording medium R is being conveyed at a specified conveyance speed. Therefore, by virtue of driving the feeding-side motor 1 at the first rotating speed corresponding to the feeding-side roll diameter and moreover driving the winding-side motor 3 at the second rotating speed corresponding to the winding-side roll diameter, the recording medium R can be conveyed at the specified conveyance speed, so that variations in conveyance quantity of the recording medium R can be suppressed. As a consequence, image-quality degradation of recorded images due to variations in conveyance quantity of the recording medium R can be avoided.

Also, the feeding-side roll diameter of the roll media 101 is actually measured by the feeding-side roll-diameter measuring unit 4. Therefore, even when used roll media 101 whose roll diameter is unknown is used, the recording medium R can be conveyed at the specified conveyance speed by rotating the feeding-side motor 1 at the first rotating speed corresponding to a measured feeding-side roll diameter of the roll media 101. Accordingly, there is no need for providing a storage device for every unit of roll media 101 to manage the remaining quantity of the recording medium R. Thus, even when used roll media 101 is used, image-quality degradation of recorded images due to variations in the conveyance quantity can be avoided by suppressing those variations in conveyance quantity of the recording medium R.

Also, not either one but both of the feeding-side motor 1 and the winding-side motor 3 are controlled for drive. As a result of this, the recording medium R can be smoothly conveyed without being subjected to unreasonable tension, facilitating suppression of variations in conveyance quantity of the recording medium R.

Also, rotating speeds of the feeding-side motor 1 and the winding-side motor 3 are controlled by measuring the feeding-side roll diameter of the roll media 101 and the winding-side roll diameter of recorded media. Therefore, the rotating speeds of the feeding-side motor 1 and the winding-side motor 3 can be appropriately controlled in such a way that the conveyance speed of the recording medium R becomes constant without being affected by the thickness of the recording medium R (no matter how thick the recording medium R is). Thus, it becomes possible to select and use, as required, a desired one from among plural pieces of roll media 101 differing in thickness of the recording medium R. As a result, it becomes possible to widen a range of options for the roll media 101 to be used.

Also, the motor drive controller 6 drives the feeding-side motor 1 in such a way that the first rotating speed continuously increases in response to continuous decrease of the feeding-side roll diameter due to feed-out of the recording medium R, and moreover the motor drive controller 6 drives the winding-side motor 3 in such a way that the second rotating speed continuously decreases in response to continuous increase of the winding-side roll diameter (S1 to S8). Since the first rotating speed and the second rotating speed continuously vary in response to continuous variations of the feeding-side roll diameter and the winding-side roll diameter, respectively, as described above, the conveyance speed of the recording medium R can be continuously maintained at the specified conveyance speed. As a result of this, image-quality degradation of recorded images can securely be avoided over the entire recording medium R.

Also, the feeding-side actuator 41 of the feeding-side roll-diameter measuring unit 4 is displaced in direct contact with the outermost circumferential surface of the roll media 101. Therefore, the feeding-side displacement sensor 42 is enabled to detect the feeding-side roll diameter with high precision based on displacement of the feeding-side actuator 41. Similarly, the winding-side actuator 51 of the winding-side roll-diameter measuring unit 5 is displaced in direct contact with the outermost circumferential surface of the recorded media 102. Therefore, the winding-side displacement sensor 52 is enabled to detect the winding-side roll diameter with high precision based on displacement of the winding-side actuator 51.

Besides, it is also allowable to use, as the feeding-side roll-diameter measuring unit 4 or the winding-side roll-diameter measuring unit 5, a noncontact sensor for measuring the feeding-side roll diameter or the winding-side roll diameter without making contact with the roll media 101 or the recorded media 102. An example of such a noncontact sensor is an optical sensor for optically detecting the feeding-side roll diameter or the winding-side roll diameter by means of emission and reception of light in the axial direction of the roll media 101 or the recorded media 102.

Also, for example, in a case where a driving roller located on a conveyance-direction downstream side of the roll media is driven with a motor to pull the recording medium so that the roll media is rotated, it results that the recording medium between the driving roller and the roll media undergoes large tension. For this reason, there may occur, more likely, slides between the driving roller and the recording medium. As a result, even with control exercised on the rotation of the driving roller, such slides may cause the conveyance quantity of the recording medium to vary. In this embodiment, since the feeding-side motor 1 transmits driving force to the shaft portion 1*a*, to which the hollow core of the roll media 101 is fitted, to rotate the shaft portion 1*a* so that the roll media 101 is rotated integrally with the shaft portion 1*a* . worries about effects of the slides are eliminated. That is, it becomes possible to avoid variations in conveyance quantity of the recording medium R due to the slides and thereby avoid any image-quality degradation of recorded images.

in this connection, cloth has thickness in comparison to paper and film. Therefore, in a case where the roll media 101 with cloth wound thereon as the recording medium R is used, larger variations in the feeding-side roll diameter due to feed-out of the recording medium R from the roll media 101 are involved, causing the conveyance quantity to be largely varied. Thus, particularly in cases where the recording medium R is cloth, the control of this embodiment is effective in which both the feeding-side motor 1 and the winding-side motor 3 are driven to maintain a constant conveyance speed (conveyance quantity per unit time) of the recording medium R.

(Another Configuration of Inkjet Recording Apparatus)

Figure 6:
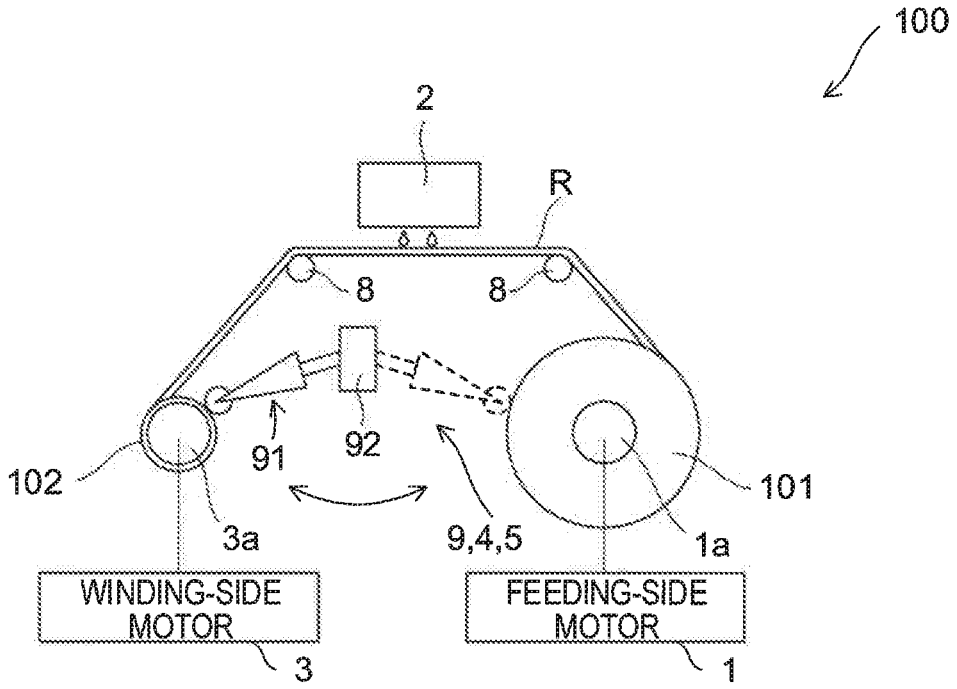
FIG. 6 is an explanatory view schematically showing another configuration of the inkjet recording apparatus.

FIG. 6 is an explanatory view schematically showing another configuration of the inkjet recording apparatus of this embodiment. The above-described feeding-side roll-diameter measuring unit 4 and winding-side roll-diameter measuring unit 5 may be each formed of an identical roll-diameter measuring unit 9. The roll-diameter measuring unit 9 is configured by including an actuator 91 and a displacement sensor 92. The actuator 91 is identical in configuration to the above-described feeding-side actuator 41 of the feeding-side roll-diameter measuring unit 4 or the above-described winding-side actuator 51 of the winding-side roll-diameter measuring unit 5. The displacement sensor 92 is identical in configuration to the above-described feeding-side displacement sensor 42 or the above-described winding-side displacement sensor 52.

Figure 7:
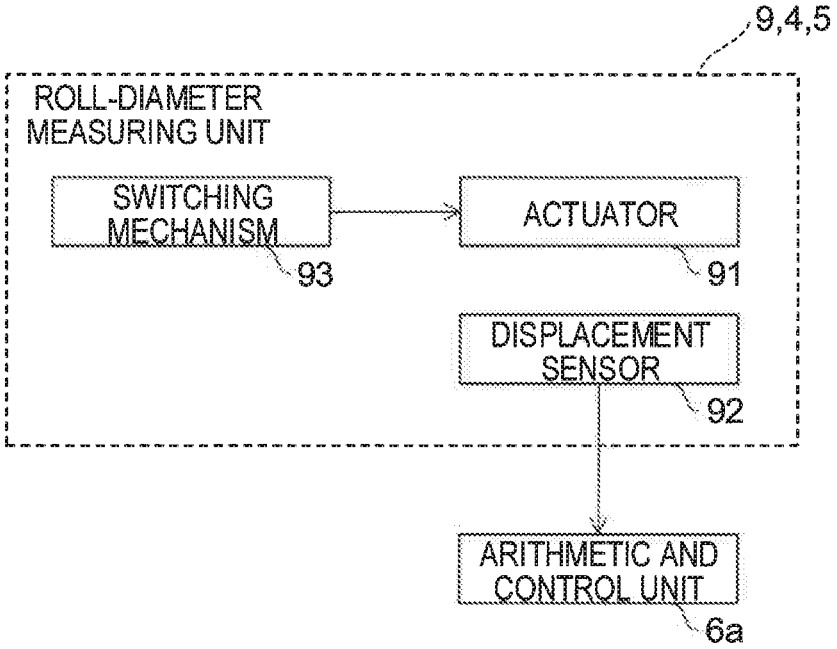
FIG. 7 is a block diagram showing a detailed configuration of a roll-diameter measuring unit in the inkjet recording apparatus of FIG. 6.

FIG. 7 is a block diagram showing a detailed configuration of the roll-diameter measuring unit 9. The roll-diameter measuring unit 9 further includes a switching mechanism 93. The switching mechanism 93 alternately switches a measuring position of the roll diameter between a position for measuring the feeding-side roll diameter of the roll media 101 and a position for measuring the winding-side roll diameter of the recorded media 102. Such a switching mechanism 93 may be implemented by a moving mechanism for pivoting or translating the actuator 91.

With this configuration, while the actuator 91 is set by the switching mechanism 93 into a position where the actuator 91 is in contact with the outermost surface of the roll media 101, the displacement sensor 92 is enabled to detect a feeding-side roll diameter of the roll media 101 on a basis of a displacement of the actuator 91. Next, while the actuator 91 is positioned in contact with the outermost surface of the recorded media 102 as a result of switching of the roll-diameter measuring position by the switching mechanism 93, the displacement sensor 92 is enabled to detect a winding-side roll diameter of the recorded media 102 on a basis of a displacement of the actuator 91, Information as to the detected feeding-side roll diameter and winding-side roll diameter is fed to the arithmetic and control unit 6*a* of the motor drive controller 6. Processes subsequent to that are similar to S3 and following steps in FIG. 5.

When the roll-diameter measuring position is alternately switched over by the switching mechanism 93 so that the feeding-side roll diameter and the winding-side roll diameter are alternately measured, individual rotating speeds of the feeding-side motor 1 and the winding-side motor 3 can be changed stepwise. For example, in cases where the recording medium R is small in thickness or where the conveyance speed of the recording medium R is set to a low one due to specifications, the recording medium R can be conveyed at a generally constant conveyance speed even with the rotating speeds of the feeding-side motor 1 and the winding-side motor 3 changed stepwise (not continuously changed). Therefore, image-quality degradation of recorded images due to variations in conveyance speed can be avoided even with stepwise changes of the individual rotating speeds.

Also, by virtue of the arrangement that allows the roll-diameter measuring position to be switched over, both the feeding-side roll diameter and the winding-side roll diameter can be measured by using a singularity of the actuator 91 and a singularity of the displacement sensor 92. As a result of this, the numbers of the actuator and the displacement sensor to be used for the measurement of the feeding-side roll diameter and the winding-side roll diameter can be reduced, as compared with the configuration of FIG. 1, allowing the apparatus to be made compact in configuration. Further, by virtue of the arrangement allowing the roll-diameter measuring position to be switched over, the apparatus interior can be laid out such that loading positions of the roll media 101 and the recorded media 102 are made near to each other. In terms of this point as well, the apparatus can be made compact.

The above embodiment has been described on the inkjet recording apparatus 100, as an example, in which a table showing a relationship between motor rotating speeds and roll diameters under conveyance of the recording medium at a specified conveyance speed is stored in the storage unit 7. However, storing the table in the storage unit 7 is not indispensable. It is also allowable, for example, that with the table stored beforehand in a server outside the inkjet recording apparatus 100, the motor drive controller 6 communicates with the server to look up to the table so that the first rotating speed corresponding to a feeding-side roll diameter is determined and moreover the second rotating speed corresponding to a winding-side roll diameter is determined. Furthermore, the motor drive controller 6 may calculate the motor rotating speeds from roll diameters.

Although this embodiment has been described on a color inkjet recording apparatus, yet the configuration and control of this embodiment is applicable also to monochrome inkjet recording apparatuses.

The present disclosure is applicable to various types of inkjet recording apparatuses for recording images on a recording medium by using roll media having the recording medium wound thereon in roll shape, such as digital printing machines that eject ink onto cloth to record images thereon.

Although an embodiment of the disclosure has been described hereinabove, the scope of the disclosure is not limited only to the above-described embodiment. The disclosure may be carried out with various changes and modifications applied thereto unless those changes and modifications depart from the gist of the disclosure.

What is claimed is:

1. An inkjet recording apparatus comprising:

a feeding-side motor for rotating roll media with a recording medium wound thereon in roll shape to feed out the recording medium from the roll media;

an inkjet recording unit for ejecting ink onto the recording medium fed out from the roll media to record an image on the recording medium;

a winding-side motor for winding, into roll shape, the recording medium with the image recorded thereon by the inkjet recording unit;

a feeding-side roll-diameter measuring unit for measuring a roll diameter of the roll media as a feeding-side roll diameter;

a winding-side roll-diameter measuring unit for measuring, as a winding-side roll diameter, a roll diameter of recorded media with the recording medium wound thereon in roll shape by the winding-side motor; and a motor drive controller for controlling respective drive of the feeding-side motor and the winding-side motor, wherein based on a relationship between motor rotating speeds and roll diameters under conveyance of the recording medium at a specified conveyance speed, the motor drive controller determines a first rotating speed corresponding to the feeding-side roll diameter measured by the feeding-side roll-diameter measuring unit and moreover determines a second rotating speed corresponding to the winding-side roll diameter measured by the winding-side roll-diameter measuring unit to drive the feeding-side motor at the first rotating speed and moreover drive the winding-side motor at the second rotating speed.

2. The inkjet recording apparatus according to claim 1, further comprising a storage unit for storing a table showing the relationship between the motor rotating speeds and the roll diameters, wherein based on the table, the motor drive controller determines the first rotating speed and moreover determines the second rotating speed.

3. The inkjet recording apparatus according to claim 1, wherein the motor drive controller drives the feeding-side motor in such a way that the first rotating speed continuously increases in response to continuous decrease of the feeding-side roll diameter due to feed-out of the recording medium, and moreover the motor drive controller drives the winding-side motor in such a way that the second rotating speed continuously decreases in response to continuous increase of the winding-side roll diameter.

4. The inkjet recording apparatus according to claim 1, wherein the feeding-side roll-diameter measuring unit includes:

a feeding-side actuator which is in contact with an outermost circumferential surface of the media and which is displaced in response to variations in the feeding-side roll diameter; and a feeding-side displacement sensor for detecting the feeding-side roll diameter based on a displacement of the feeding-side actuator.

5. The inkjet recording apparatus according to claim 1, wherein the winding-side roll-diameter measuring unit includes:

a winding-side actuator which is in contact with an outermost circumferential surface of the recorded media and which is displaced in response to variations in the winding-side roll diameter; and a winding-side displacement sensor for detecting the winding-side roll diameter based on a displacement of the winding-side actuator.

6. The inkjet recording apparatus according to claim 1, wherein the feeding-side roll-diameter measuring unit and the winding-side roll-diameter measuring unit are each formed of an identical roll-diameter measuring unit, and the roll-diameter measuring unit includes a switching mechanism for alternately switching a roll-diameter measuring position between a position for measuring the feeding-side roll diameter of the roll media and a position for measuring the winding-side roll diameter of the recorded media.

7. The inkjet recording apparatus according to claim 1, wherein the feeding-side motor transmits driving force to a shaft portion, to which a hollow core of the roll media is fitted, to rotate the shaft portion, whereby the roll media is rotated.

8. The inkjet recording apparatus according to claim 1, wherein the recording medium is cloth.

9. An inkjet recording method comprising the steps of:

rotating roll media with a recording medium wound thereon in roll shape by a feeding-side motor to feed out the recording medium from the roll media;

ejecting ink onto the recording medium fed out from the roll media to record an image on the recording medium;

winding, into roll shape, the recording medium with the image recorded thereon by a winding-side motor;

measuring a roll diameter of the roll media as a feeding-side roll diameter;

measuring, as a winding-side roll diameter, a roll diameter of recorded media with the recording medium wound thereon in roll shape by the winding-side motor; and based on a relationship between motor rotating speeds and roll diameters under convey of the recording medium at a specified conveyance speed, determining a first rotating speed corresponding to the feeding-side roll diameter and moreover determining a second rotating speed corresponding to the winding-side roll diameter to drive the feeding-side motor at the first rotating speed and moreover drive the winding-side motor at the second rotating speed.

* * * * *